United States Patent [19]

Holmes

[11] 4,139,093

[45] Feb. 13, 1979

[54] HINGED HOLDER FOR DISC-LIKE OBJECTS

[75] Inventor: Gordon W. Holmes, Mississauga, Canada

[73] Assignee: Professional Packaging Limited, Mississauga, Canada

[21] Appl. No.: 864,819

[22] Filed: Dec. 27, 1977

[30] Foreign Application Priority Data

Apr. 5, 1977 [CA] Canada ..... 275578

[51] Int. Cl.[2] ..... A45C 11/00; B65D 11/20

[52] U.S. Cl. ..... 206/0.82; 206/445; 220/4 B; 220/339

[58] Field of Search ..... 206/0.82, 0.81, 0.84, 206/0.83, 445; 220/339, 4 E, 4 B

[56] References Cited

U.S. PATENT DOCUMENTS

| | | | |
|---|---|---|---|
| 1,010,346 | 11/1911 | Burn | 206/0.82 |
| 2,999,611 | 9/1961 | Paulson | 220/4 E |
| 3,198,196 | 8/1965 | Sawin | 220/339 |
| 3,402,806 | 9/1968 | Sutherland et al. | 206/0.82 |

FOREIGN PATENT DOCUMENTS

| | | | |
|---|---|---|---|
| 1141175 | 12/1962 | Fed. Rep. of Germany | 220/339 |

*Primary Examiner*—William T. Dixson, Jr.
*Attorney, Agent, or Firm*—Sim & McBurney

[57] ABSTRACT

A holder for coins or other disc-like objects is constructed of polymeric material and consists of an elongate hollow cylindrical body of inside diameter substantially that of the coins to be packaged therein and having end openings which are of smaller diameter. The elongate body is formed of two semi-circularly cross-sectioned portions which are integrally hingedly joined together at one common edge and releasably joined together at the other common edge. Release of the snap join enables the body to be opened and the hinging of the two portions relative to each other enables access to the interior of the body to be gained.

7 Claims, 6 Drawing Figures

FIG. 5.
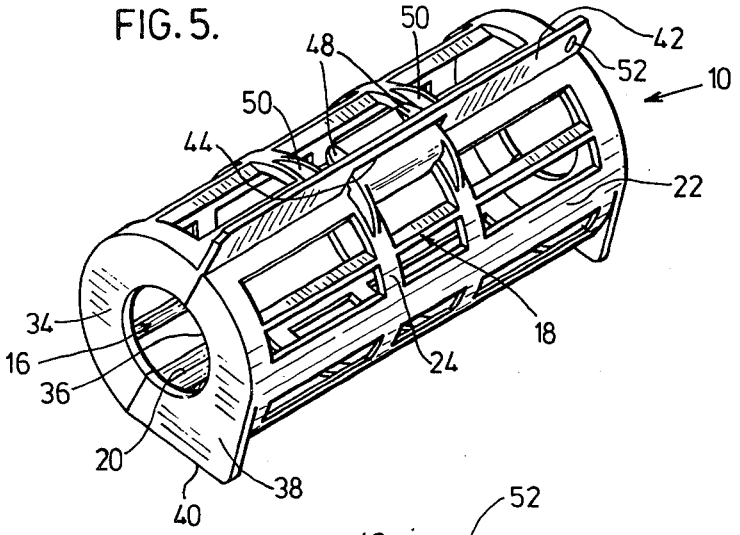
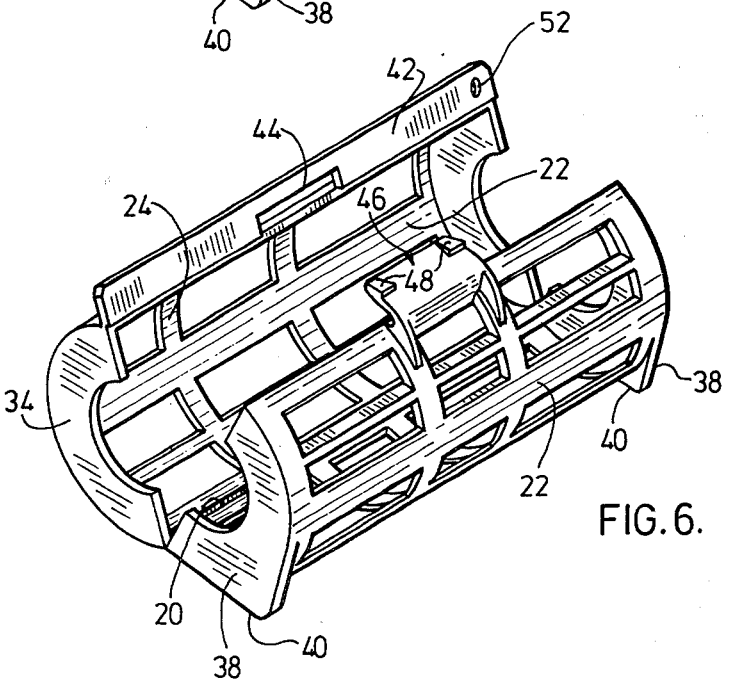
FIG. 6.

HINGED HOLDER FOR DISC-LIKE OBJECTS

FIELD OF INVENTION

This invention relates to a holder for disc-like objects, such as coins, tokens and the like.

BACKGROUND TO THE INVENTION

In the handling, distribution and banking of coins, coins are packaged according to specific established numbers, depending on the denomination of the coins. The most common means of packaging the coins is a paper wrapper which is applied around a cylinder of the coins by hand or by automatic machine, the ends of the wrapper being folded over to retain the coins in place. Spiral-wound paper tubes also are used and provide a more rigid carrier although the open ends of the tube require to be crimped or beaded to retain the coins in place. Since the package provided in this manner is opaque, external printing is required to identify the contents.

This prior art packaging procedure suffers from many disadvantages which are currently tolerated for lack of viable and inexpensive alternative.

It is customary for the larger financial institutions to wrap coins automatically with the traditional numbers of coins and distribute the roll packages to retailers and other coin users. Retailers usually check the count of the coins upon opening the roll to ensure the correct number is present. Discrepancies of one or more coins short or over are often found as a result of the ability of the paper wrapper readily to adjust to incorrect numbers of coins and the only recourse is to double check the numbers, a time consuming and tedious operation. Further, when the paper tube type package is used, it is not uncommon for the tube to be disposed of with a coin or coins still positioned in the tube, the lack of detection of this coin arising from its light weight character.

Dexterity and skill are required to wrap coins manually in the paper wrappers and many people find it impossible or extremely difficult to form the wrapped cylinders of coins. This is especially true of older persons and young people. When coins are not properly wrapped and the ends sealed, coins can fall out, leading to considerable aggrevation, and time and material wastage.

Hand counted coin packages often have improper numbers, especially where higher number of coins are involved, leading to the necessity for a bank receiving such rolls to double check the numbers before crediting the customer.

Further, due to the opaque nature of the rolls and hence the lack of ability to visually observe the contents without breaking open the roll, there is a considerable opportunity to substitute worthless slugs, cheaper coins or foreign coins in a roll of coins, which, if undetected, leads to an appropriate loss for the bank or other recipient.

The rolls of coins, especially in the form of paper wrapped rolls, are not resistant to rough handling and hence there is a tendency for such rolls to split open or to become unrolled when bags containing them are dropped or roughly handled, leading to the necessity of counting and wrapping the coins anew.

The cylindrical nature of the coin rolls allows them to roll readily on surfaces on which they are positioned, for example, a table, and such rolling may result in the rolls falling onto the floor and breaking open, with consequent problems of collection and reassembly.

When the roll packages are opened to remove the coins therefrom, it is usual to split open the roll in the middle or some other location along its length and then throw the wrapper away. Such wrappers thus are usually used only once.

SUMMARY OF INVENTION

The present invention provides a unique reusable coin holder which overcomes all the prior art problems attendant the paper wrappers. The reusable coin holder preferably is constructed of flexible polymeric material, such as, polypropylene, and is capable of being manually or machine loaded with coins, tokens or other disc-like objects.

The coin or other disc-like object holder of the present invention consists of an elongate hollow cylindrical body having a generally circular cross section of diameter substantially that of the disc-like objects to be packaged therein and end openings dimensioned less than the dimension of the disc-like objects to prevent passage of the same through the end opening. The elongate body is formed of two semi-circularly cross-sectioned portions hingedly joined together at one common edge and releasably joined together at the other common edge. The releasable joining of the two portions enables the body to be opened by release of the join and access to the interior of the body to be attained by hinging of the two portions relative to each other.

BRIEF DESCRIPTION OF DRAWINGS

FIG. 5 is a perspective view of a coin holder in accordance with a second embodiment of the invention in a closed position; and FIG. 6 is a perspective view of the coin holder of FIG. 5 in an open position.

DESCRIPTION OF PREFERRED EMBODIMENTS

Figure 1:
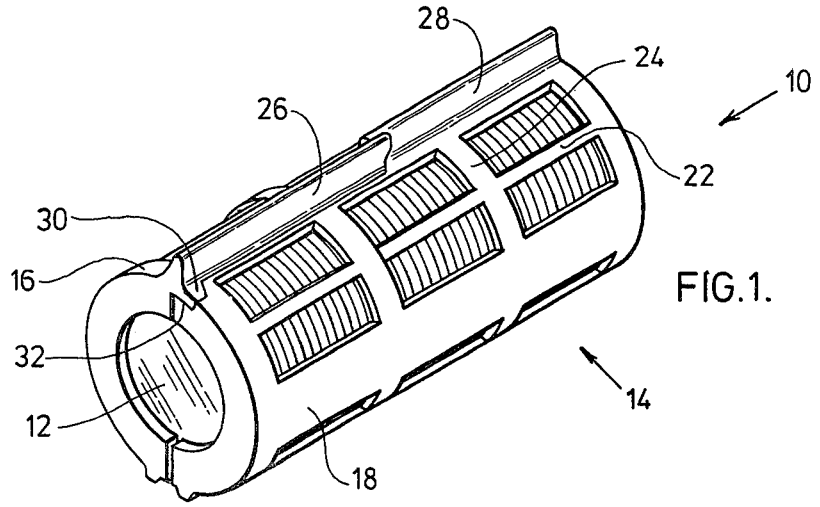
FIG. 1 is a perspective view of a closed holder containing coins in accordance with one embodiment of the invention.
Figure 2:
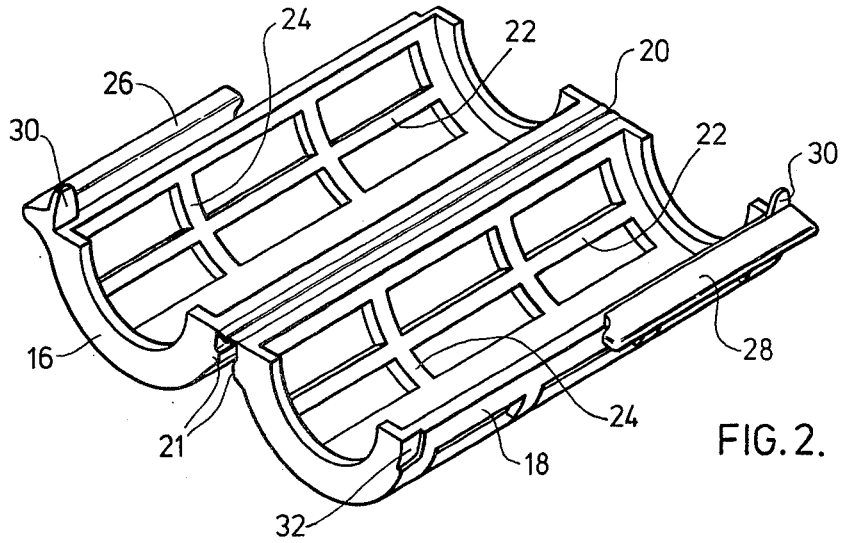
FIG. 2 is a perspective view of the holder of figure in an open position with coins removed.
Figure 4:
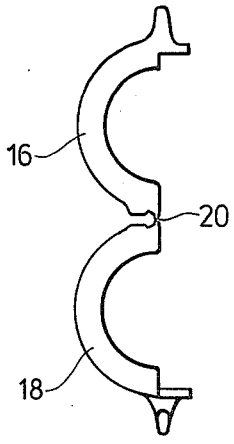
FIG. 4 is an end view of the holder of FIG. 1 in an open position.
Figure 3:
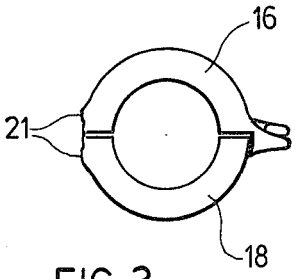
FIG. 3 is an end view of the holder of FIG. 1 in a closed position.

Referring first to the embodiment of FIGS. 1 to 4, a holder 10 for coins 12 or other disc-like objects has an enclosed hollow cylindrical body 14 comprised of two semi-circularly cross-sectioned halves 16 and 18 which are hingedly joined to each other through a living hinge 20 formed at one common edge thereof tending to spring open the halves 16 and 18.

The living hinge 20 is illustrated as extending continuously along a common longitudinal edge of the two halves 16 and 18. This construction represents a preferred embodiment of the invention and other constructions may be provided.

For example, the hinge 20 may be provided by any desired hinging arrangement, for example, at spaced longitudinal locations. Further, the hinge may be formed laterally of one end wall of the coin holder rather than the illustrated longitudinal relation so that the two halves open about such an end wall. In the latter construction, the locking mechanism, described below, are provided in the other end wall of the coin holder.

Elongate projections 21 are provided parallel to and on either side of the hinge joint 20 to allow the holder 10 sit on a flat surface without rolling.

Each of the body halves 16 and 18 has a plurality of parallel longitudinal ribs 22 and a plurality of parallel arcuate ribs 24 located perpendicularly to the longitudinal ribs 22 to define an open framework through which the coins 12 may be seen.

The body halves 16 and 18 are releasably joined together at the common edge opposite the hinge 20. The releasable join is achieved in the illustrated embodiment of FIGS. 1 to 4, by the snap overlapping of the adjacent ends of two upstanding elongate flanges 26 and 28 integrally formed one with each of the body halves 16 and 18 and extending from opposite ends of the holder 10 to an overlapping condition at their inboard ends.

It is possible to use any other desired releasable locking arrangement, such as the one described below with respect to FIGS. 5 and 6. The projecting flanges 26 and 28 also inhibit the holder 10 from rolling.

At the outboard end of each flange 26 and 28 there is formed an integral projection 30, which extends in a circumferential direction away from the one of the halves having the upstanding projection and into engagement with a correspondingly shaped recess 32 formed in the other of the halves when the holder is closed, as seen in FIG. 1. The interaction of the projections 30 in the recesses 32 adds dimensional stability to the holder 10 in its closed position and also prevents the snap locking device from accidentally disengaging due to lateral distortion of the two halves of the holder.

The holder 10 is provided with end walls 32 of annular shape which define a circular end opening 36 of diameter less than the diameter of the coins 12 to prevent passage of coins through the ends of the holder 10. The opening 36 is coaxial with the body of the holder 10. Each end wall 34 is formed of two semi-circular portions each integrally formed with one of said halves 16 and 18.

Access to the interior of the holder 10 for the insertion or removal of coins may be had by release of the overlapping of the flanges 26 and 28. The spring action of the hinge 20 assists in the opening operation.

Turning now to the embodiment of FIGS. 5 and 6, which represents the current best mode of the invention, the coin holder 10 in this embodiment is constructed in similar manner to the coin holder 10 illustrated in FIGS. 1 to 4 and common elements will not be described.

In place of the elongate projections 21, in the embodiment of FIGS. 5 and 6 there are provided two wings 38 integrally formed one at each end of the body half 18. Each wing 38 is provided with a lower edge 40 which act as feet for the coin holder 10.

In place of the overlapping flanges in the embodiment of FIGS. 1 to 4 to achieve the releasable join, there is utilized in the embodiment of FIGS. 5 and 6 a different releasable join structure which is more positive and superior to that used in FIGS. 1 to 4.

A single elongate upstanding flange 42 is provided at the curvilinear extremity of one body half 16 and an elongate slot 44 is formed at about the midpoint along the length of the flange 42. The holder 10 is formed so that the plane in which the flange 42 lies bisects the living hinge 20.

At the curvilinear extremity of the other body half 18 is formed a resiliently flexible tongue member 46 which extends away from that extremity generally tangentially with respect to the body half 14 and has a lateral dimension slightly less than the length of the slot 44 to allow passage therethrough. A pair of wedge-shaped projections 48 is formed at the extremity of the tongue 46 remote from the body half 18.

As the tongue 46 is received in the slot 44, the tongue 46 is caused to flex downwardly as the upper surface of the slot 44 rides up the projections 48 until the projections 48 clear the slot 44 at which point the tongue 46 snaps upward, so that the interference between the rear faces of the projections 48 and the adjacent face of the flange 42 connects the two halves 16 and 18 together and retains the holder 10 in a closed position. The tongue 46 is dimensioned so that the projections 48 clear the slot 44 just as the two halves 16 and 18 close, so that the holder 10 snugly encloses coins positioned therein.

The holder 10 is opened by pressing down on the tongue 46 until the projections 48 clear the top edge of the slot 44, and can be withdrawn through the slot 44. The spring action of the living hinge 20 assists in this opening of the holder 10.

Arcuate ribs 50 are positioned on opposite sides of the slot 44 to prevent accidental depression of the tongue 46 when the holder 10 is closed and thereby prevent accidental opening of the holder 10.

An opening 52 may be provided adjacent one end of the flange 42 to receive a key ring attachment or the like, so that the holer 10 may be transported and used in this manner.

While the structure of the embodiment of FIGS. 5 and 6 has been described with reference to the flange 42 and associated slot 44 being integrally-formed with the curvilinear extremity of the body half 16 and the tongue 46 being integrally-formed with the curvilinear extremity of the body half 18, the locations of the flange 42 and tongue 46 may be reversed, if desired.

The holder 10 in the embodiments of FIGS. 1 to 6, may be constructed of any suitable material, such as, a polymeric material. Where the latter material is used, then the holder 10 may be readily formed by molding as a single piece.

The coin holder 10 may be partially filled with coins and one or more coins may be added to the holder from time to time, which is not possible with conventional paper wrappers. This feature allows the coin holder to be used as a savings bank for coins over a period of time, until the coin holder has been completely filled up ready for bank deposit.

Suitable indicia may be provided, for example, on one of the longitudinal ribs 22 to enable numbers of coins less than that filling the holder 10 to be counted.

The coin holder 10, therefore, may replace loose saving of coins in a receptacle, such as a piggy bank, and eliminates the necessity to sort and count such coins prior to their bank deposit.

A number of such coin holders 10 may be provided for different denomination coins in a storage device, so that saved coins are sorted and stored in a single convenient device.

The holders 10 are constructed to receive only the exact number of coins of the particular denomination. Even allowing for marginally different thickness of coins due to wear, the holder 10 is incapable of packaging more coins than intended and the absence of one or more coins is readily detected visually by gaps and/or audibly by rattling of the coins in the holder. The prior art problems associated with incorrect numbers being packaged are thus overcome.

The holder 10 may be color-keyed for different denominations and/or numbers, to assist in facilitating counting and sorting of large shipments of stocks of coinage and to avoid confusion between coins of a similar size.

The holder is rugged and capable of reuse many times before it becomes unsuitable for continued use. This contrasts markedly with the one-time use of paper wrappers.

The ready opening of the holder 10 into two convenient halves and the simple closure operation allows easy filling of the holder 10 without the manual dexterity required with the conventional paper wrappers. The open nature of the body 12 allows ready detection of slugs, foreign coins or improperly sized coins in the holder 10, and the consequent losses and possibilities for fraudulent practices prevalent with the prior art are avoided.

The exterior surface of the holder 10 may be provided with identifying information, for example, the number and denomination of the coins, total value of the coins and bank or other source identification. Suitable locations for such information are the longitudinal ribs 22.

The present invention, therefore, provides a plastic coin holder of unique design which is superior to conventional coin packaging operations. Modifications are possible within the scope of the invention.

What I claim is:

1. A holder for disc-like objects constructed of polymeric material and formed by molding as an integral element, consisting of an elongate hollow cylindrical body having a generally circular cross-section of diameter substantially that of the disc-like objects to be packaged therein, and continuous integral annular end walls which define circular openings at the ends of the body having a diameter less than the diameter of the coins and having the same centre of curvature as that of the body, said elongate body being formed of two semi-circularly cross-sectioned portions hingedly joined together at one common edge by a continuous longitudinal living hinge that biases said body portions apart and releasably joined together at the other common edge to enable opening of said body to occur at the other common edge and hinging of the two portions relative to each other to occur along said continuous hinge to gain access to the interior of the body, said releasable join being provided by the interaction of at least one wedge-shaped upwardly-extending projection provided at and tapering towards the arcuate extremity of a resiliently flexible tongue extending from adjacent the midpoint along the length of one curvilinear extremity of said body and a slot having a length slightly greater than the transverse dimension of the tongue and formed in an upright flange extending from the other curvilinear extremity of said body in a plane which passes through the body hinge line, said slot receiving said tongue therethrough.

2. The holder of claim 1 including upstanding radial flanges on said body adjacent said other curvilinear extremity positioned on opposite longitudinal sides of said slot to prevent accidental dislodgement of said tongue and opening of said holder.

3. The holder of claim 1 wherein said upright flange has an opening therethrough adjacent one end thereof.

4. The holder of claim 1 wherein said at least one wedge-shaped projection is constituted by a pair of laterally-spaced wedge-shaped projections formed on said tongue.

5. The holder of claim 1 including projections constructed to permit said holder to stand on a flat surface without rolling constituted by planar projections of said end walls.

6. The holder of claim 1 wherein said body has an open framework defined by longitudinally extending ribs and arcuately extending ribs to permit viewing of the contents of the holder without opening the same.

7. The holder of claim 6 including indicia formed on at least one of said longitudinal ribs for determination of partial numbers of coins in the holder.

* * * * *